US010730324B2

(12) United States Patent
Yajima et al.

(10) Patent No.: US 10,730,324 B2
(45) Date of Patent: Aug. 4, 2020

(54) INKJET PRINTER

(71) Applicant: SEIKO EPSON CORPORATION, Tokyo (JP)

(72) Inventors: Yasushi Yajima, Minowa-machi (JP); Tomosuke Gomi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/528,365

(22) Filed: Jul. 31, 2019

(65) Prior Publication Data

US 2020/0039257 A1 Feb. 6, 2020

(30) Foreign Application Priority Data

Jul. 31, 2018 (JP) ..... 2018-143272

(51) Int. Cl.
*B41J 19/00* (2006.01)
*B41J 2/175* (2006.01)
*B41J 19/20* (2006.01)

(52) U.S. Cl.
CPC ..... *B41J 19/005* (2013.01); *B41J 2/175* (2013.01); *B41J 19/202* (2013.01); *B41J 2202/13* (2013.01); *B41J 2202/20* (2013.01)

(58) Field of Classification Search
CPC ..... B41J 19/005; B41J 2/175; B41J 19/202; B41J 2202/13; B41J 2202/20; B41J 15/12; B41J 29/02
See application file for complete search history.

(56) References Cited

U.S. PATENT DOCUMENTS 7,909,442 B2 * 3/2011 Samoto ..... B41J 2/17509 347/103
2012/0050416 A1 * 3/2012 Ishizawa ..... B41J 29/02 347/85
2013/0278674 A1 10/2013 Ota

FOREIGN PATENT DOCUMENTS

JP 2013-220657 10/2013

* cited by examiner

*Primary Examiner* — Thinh H Nguyen
(74) *Attorney, Agent, or Firm* — Workman Nydegger

(57) ABSTRACT

An inkjet printer comprising: a carriage that carries an inkjet head and configured to scan a recording medium; a main circuit board with a controller that controls the carriage; a strap including a first cable that connects to a first circuit board disposed on the carriage and to the main circuit board, a second cable that connects to a second circuit board disposed on the carriage and to the main circuit board, and a clamp configured to bundle the first cable and the second cable; a support member configured to support the strap from vertically below; and an ink tube configured to connect to the inkjet head and to an ink tank located outside of the carriage; the ink tube disposed between the strap and the support member.

8 Claims, 11 Drawing Sheets

INKJET PRINTER

CROSS-REFERENCE TO RELATED APPLICATION

This application is based upon Japanese Patent Application 2018-143272 filed on Jul. 31, 2018, the entire contents of which are incorporated by reference herein.

BACKGROUND

The present disclosure relates to an inkjet printer.

Recording devices having strap that bends while moving, and a support member that supports the strap at a position vertically below the strap, are known from the literature. See, for example, JP-A-2013-220657.

SUMMARY

When there are multiple such straps in the recording device, multiple straps must be held together in a single bundle by means of a clamp so that the multiple straps can move easily.

When a strap bends while moving, the strap moves through an area over the support member, and an area separated from the support member. At this time, the clamp also moves through the area over the support member, and the area removed from the support member.

A problem with this configuration is that when the clamp moves from the area separated from the support member to the area over the support member, the clamp and the support member collide and make noise.

According to present disclosure, an inkjet printer includes: a carriage that carries an inkjet head and configured to scan a recording medium; a main circuit board with a controller that controls the carriage; a strap including a first cable that connects to a first circuit board disposed on the carriage and to the main circuit board, a second cable that connects to a second circuit board disposed on the carriage and to the main circuit board, and a clamp configured to bundle the first cable and the second cable; a support member configured to support the strap from vertically below; and an ink tube configured to connect to the inkjet head and to an ink tank located outside of the carriage; the ink tube disposed between the strap and the support member.

In an inkjet printer according to another aspect of the present disclosure, the clamp has, on the support member side, a recess extending lengthwise to the strap.

In an inkjet printer according to another aspect of the present disclosure, the ink tube is bundled with the first cable and second cable.

In an inkjet printer according to another aspect of the present disclosure, the clamp has a tube holder configured to hold the ink tube.

In an inkjet printer according to another aspect of the present disclosure, a part of the ink tube that contacts the tube holder along the length of the ink tube is exposed on the support member side.

An inkjet printer according to another aspect of the present disclosure, further includes a tube clamp configured to hold the ink tube. And, the tube clamp is attached to the clamp.

In an inkjet printer according to another aspect of the present disclosure, a part, along the length of the ink tube, of the ink tube that contacts the tube clamp is exposed on the support member side.

In an inkjet printer according to another aspect of the present disclosure, the ink tube is movable freely relative to the strap.

Other objects and attainments together with a fuller understanding of the invention will become apparent and appreciated by referring to the following description and claims taken in conjunction with the accompanying drawings.

DESCRIPTION OF EMBODIMENTS

Embodiments of the invention are described below with reference to the accompanying figures. Note that parts are shown in the accompanying figures in sizes enabling easy recognition thereof and differ from the actual scale of the actual parts.

Embodiment 1

Figure 1:
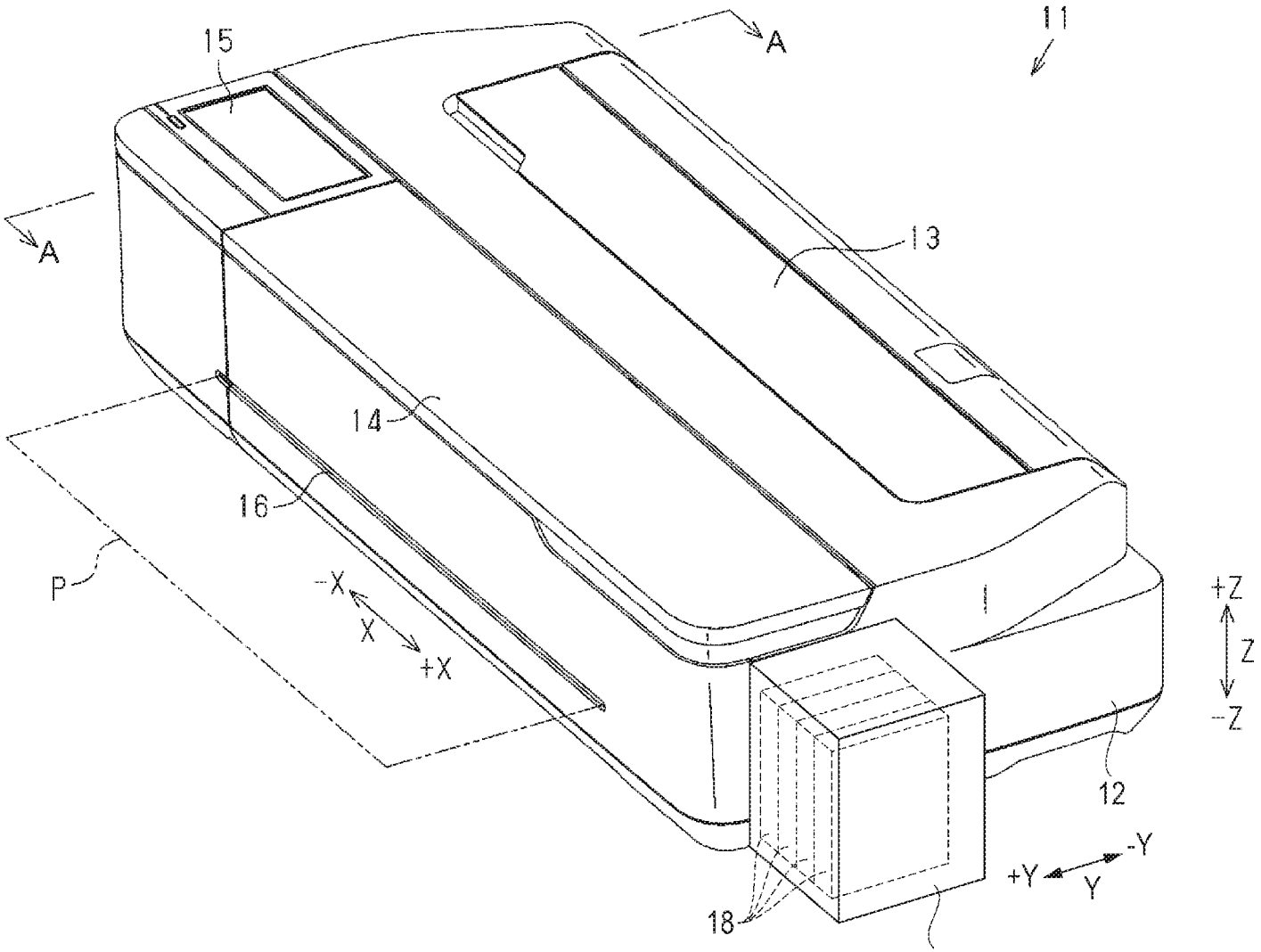
FIG. 1 is a perspective view illustrating the configuration of an inkjet printer according to a first embodiment.

FIG. 1 is a perspective view illustrating the configuration of an inkjet printer 11 according to a first embodiment of the invention.

The following description assumes that the inkjet printer 11 shown in FIG. 1 is placed on a horizontal surface, the directions to the top (vertically above) and bottom (vertically below) of the inkjet printer 11 are the Z-axis; and the X-axis and Y-axis are on the horizontal plane. More specifically, when looking at the inkjet printer 11 from the front, the X-axis direction across the width, the Y-axis direction from front to back (the depth), and the Z-axis direction along the height are mutually different directions and perpendicular to each other.

As shown in FIG. 1, the inkjet printer 11 has a basically rectangular case 12. A maintenance cover 14 that opens and closes is disposed on the top of the case 12 in front of the paper supply cover 13, which is located at the back.

An operating panel 15 for receiving commands related to inkjet printer 11 operation is also disposed on the top of the case 12 at a position beside the maintenance cover 14 on the X-axis.

Disposed in the front of the case 12, which is the side of the case 12 on the +Y direction side of the Y-axis, is a paper exit 16 enabling discharging to the front the paper P that is printed on as an example of recording media inside the case 12.

Tank storage 19 for holding ink tanks 18 is disposed to the side of the case 12. In other words, the inkjet printer 11 according to this embodiment is an off-carriage printer having the ink tanks 18 disposed off of the carriage 23. In this embodiment, the side of the case 12 to which the tank storage 19 is disposed is the side facing the +X direction.

The tank storage 19 is a basically rectangular box that is fastened to the case 12 by screw or bolt, for example. The ink tanks 18 are housed inside the tank storage 19. In this embodiment, multiple ink tanks 18 are held inside the tank storage 19. The example in FIG. 1 shows four ink tanks 18 installed in the tank storage 19.

An ink tank 18 is a container capable of storing ink. Configurations in which each ink tank 18 stores a different type of ink, configurations in which the same type of ink is stored in each ink tank 18, and configurations in which some of the multiple ink tanks 18 store the same type of ink while other ink tanks 18 store different types of ink, are possible.

One example of a type of ink is the color of the ink. Therefore, this embodiment anticipates both a configuration in which each of the multiple ink tanks 18 holds a different color of ink, and a configuration in which all of the ink tanks 18 store the same color of ink. The colors of ink in one example are black, yellow, magenta, and cyan. Other examples of the type of ink include inks made with dye, and inks made with pigment.

Figure 4:
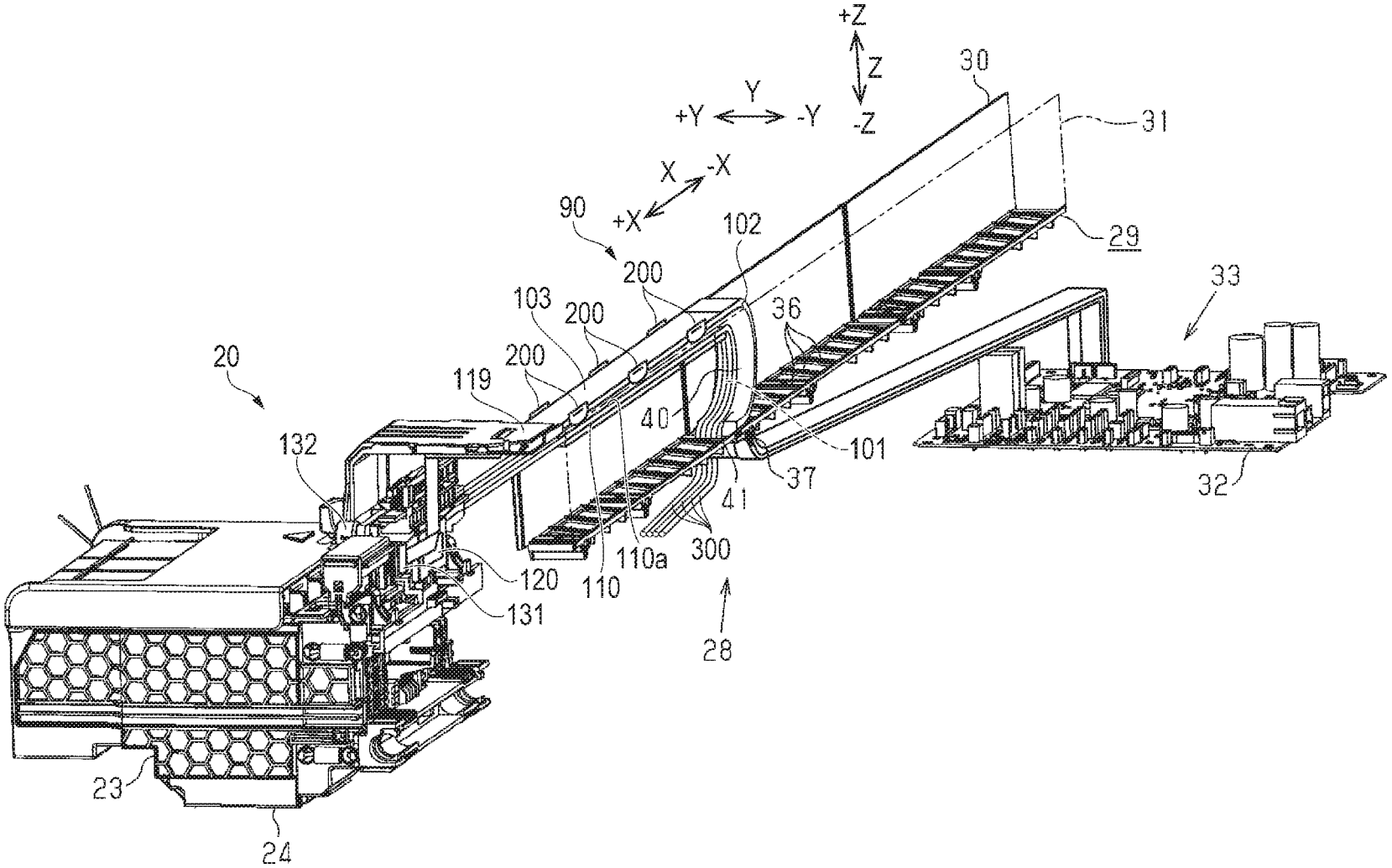
FIG. 4 is a perspective view of the print mechanism according to the first embodiment.

The ink tanks 18 and inkjet head 24 are connected by ink tubes 300. In this embodiment, four ink tubes 300 connect the ink tanks 18 to the inkjet head 24. The ink tubes 300 are flexible tubing. As shown in FIG. 4, ink stored in the ink tanks 18 is supplied through the ink tubes 300 to the inkjet head 24.

Each ink tank 18 has an ink inlet not shown. The ink tank 18 can be refilled with ink by inserting to the ink inlet an ink refill bottle holding ink for refilling the ink tank 18.

Figure 2:
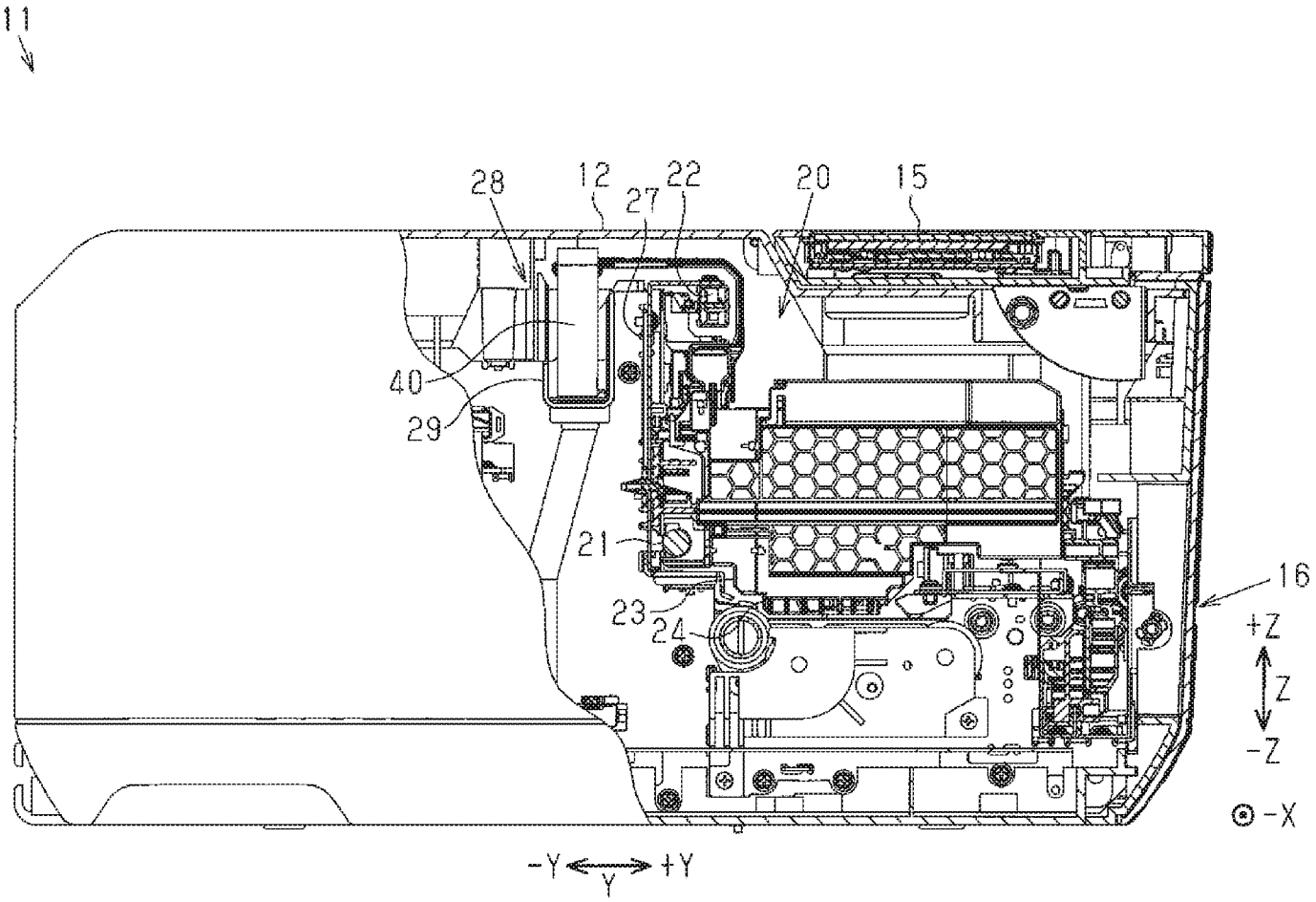
FIG. 2 is a partial section view showing the configuration of the inkjet printer according to the first embodiment.

FIG. 2 is a partial section view showing the configuration of the inkjet printer 11. More specifically, FIG. 2 is a section view through A-A in FIG. 1.

As shown in FIG. 2, the inkjet printer 11 has a print mechanism 20 that prints images, including text and graphics, on the paper P inside the case 12. The print mechanism 20 includes a main guide rail 21 and a secondary guide rail 22 inside the case 12.

The main guide rail 21 and secondary guide rail 22 extend along the X-axis. The main guide rail 21 is located substantially in the center of the case 12 on the Z-axis. The secondary guide rail 22 is located above the main guide rail 21 inside the case 12.

The print mechanism 20 also includes a carriage 23 that supports the main guide rail 21 and secondary guide rail 22 movably, and an inkjet head 24 that is supported by the carriage 23 and moves bidirectionally with the carriage 23 along the X-axis, which is the main scanning direction. As described above, because the ink tank 18 is located outside (off) the carriage 23, the ink tank 18 does not move bidirectionally on the X-axis with the carriage 23.

Figure 3:
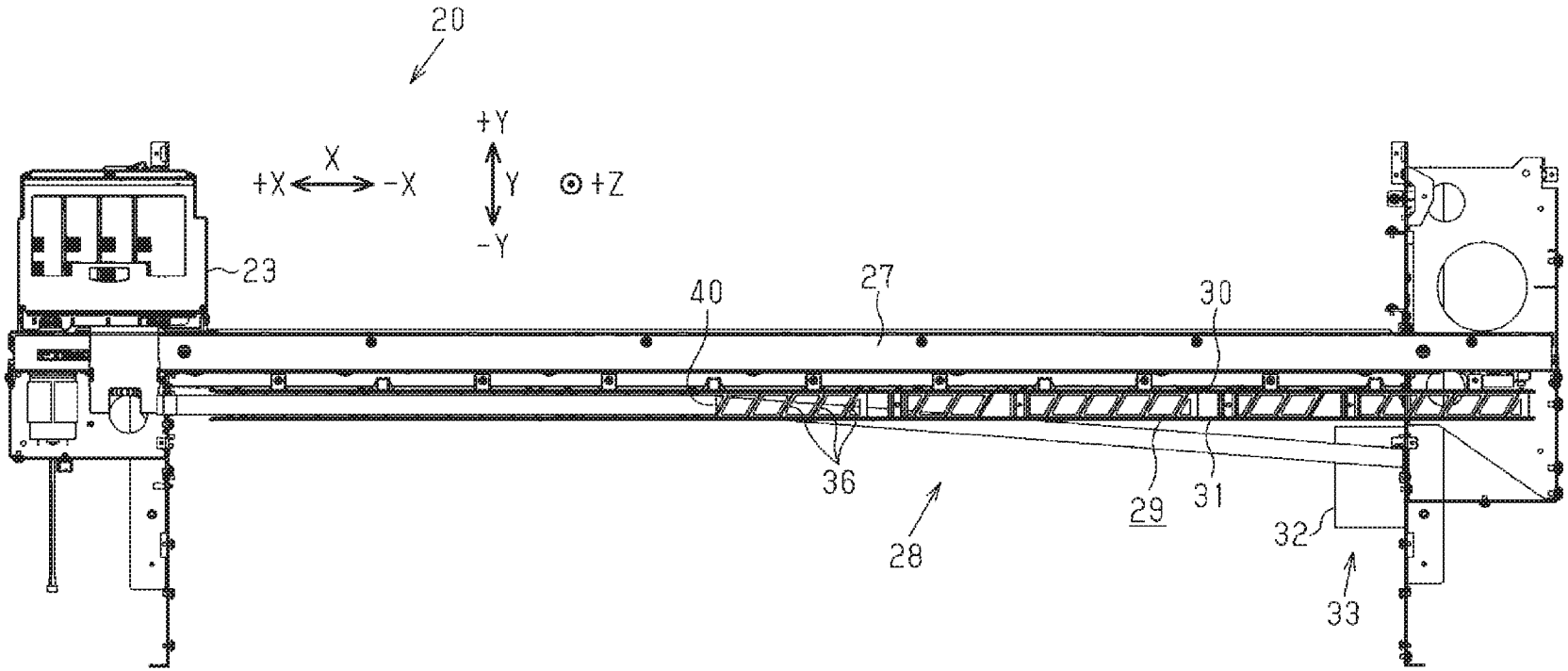
FIG. 3 is a plan view of the print mechanism according to the first embodiment.
Figure 5:
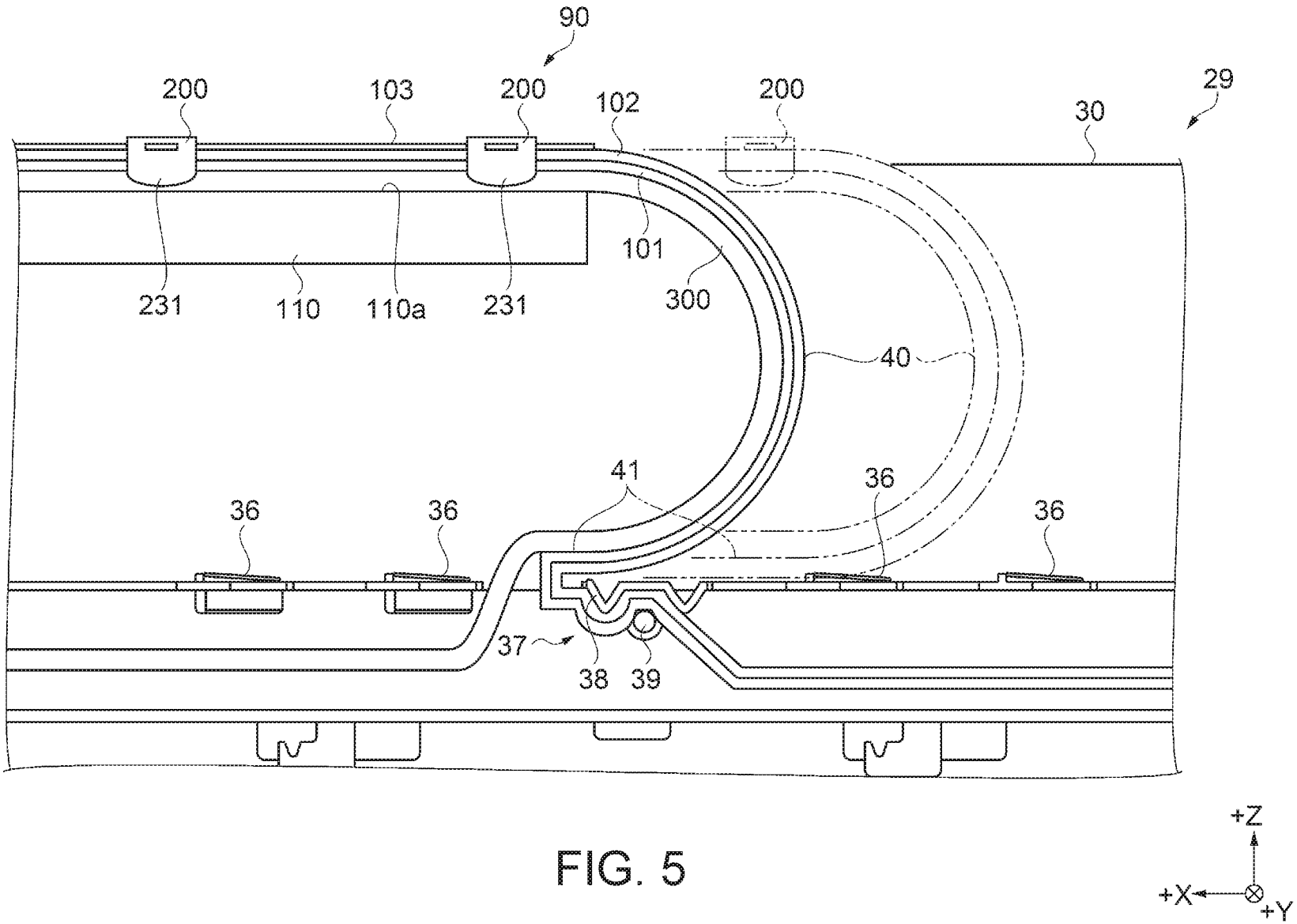
FIG. 5 is a partial section view showing the configuration around the cable support mechanism according to the first embodiment.

FIG. 3 is a plan view illustrating the print mechanism 20, and FIG. 4 is a perspective view illustrating the print mechanism 20. FIG. 5 schematically illustrates the configuration around a cable support mechanism 28.

As shown in FIG. 3 and FIG. 4, the inkjet head 24 moves bidirectionally with the carriage 23 on the X-axis. More specifically, the inkjet head 24 prints images on the paper P by ejecting ink to the paper P while travelling bidirectionally on the X-axis over the paper P.

As shown in FIG. 2 and FIG. 3, the print mechanism 20 has a metal frame 27 that is long on the X-axis, that is, the main scanning direction. The frame 27 is disposed on the Y-axis to a position on the −Y direction side of the range of carriage 23 travel. The contour of the frame 27 when seen from the X-axis end is substantially rectangular and long on the Z-axis. The main guide rail 21 is located at the inside bottom part, and the secondary guide rail 22 is located at the inside top part of the hollow contour of the frame 27.

The cable support mechanism 28 is disposed on the Y-axis at a position on the −Y direction side of the frame 27.

When seen from the X-axis direction, the cable support mechanism 28 is U-shaped with the opening at the top and has a guide member 29 extending on the X-axis.

The guide member 29 is shorter than the frame 27 on the X-axis and is supported by the frame 27. When the guide member 29 is supported by the frame 27, the bottom of the guide member 29 is located on the bottom on the −Z direction side and has a surface extending in the X-axis and Y-axis directions. Of the side walls of the guide member 29 supported by the frame 27, side wall 30, which is on the +Y direction side, is opposite the −Y direction side of the frame 27. Note that for ease of understanding the internal structure of the guide member 29, the side wall 31 on the −Y direction side of the guide member 29 is indicated by a double dot dash line in FIG. 4.

As shown in FIG. 3 and FIG. 4, a control board 33 having integrated circuit devices mounted on a circuit board 32 is disposed to the cable support mechanism 28 below the −X direction end of the guide member 29.

The control board 33 controls the drivers that drive the carriage 23, inkjet head 24, and various sensors. The control board 33 includes a CPU (central processing unit) for executing programs, RAM (random access memory) for temporarily storing data and programs, ROM (read-only memory) storing previously nonvolatilely recorded data and programs, and interfaces. The CPU processes signal input through the interfaces' based data stored in RAM and ROM, and outputs control signals through the interfaces to the appropriate drivers.

As shown in FIG. 4 and FIG. 5, the inkjet printer 11 has a strap 90 that connects the carriage 23 and circuit board 32.

The strap 90 includes a first cable 101 that electrically connects the carriage 23 and control board 33, and a second cable 102 that also electrically connects the carriage 23 and control board 33. In other words, the first cable 101 and the second cable 102 connect to the control board 33. The first and second cables 101 and 102 are flexible flat cables (FFC). The first cable 101 and the second cable 102 are ribbon-like, flexible, and bendable. In this embodiment, the control board 33 controls ink ejection by the inkjet head 24 by control signals sent through the second cable 102 to the inkjet head 24.

As shown in FIG. 5, the first cable 101 and second cable 102 have a portion that is flat on the Y-axis direction. The first cable 101 and second cable 102 are disposed so that flat portions are opposite each other.

Figure 6:
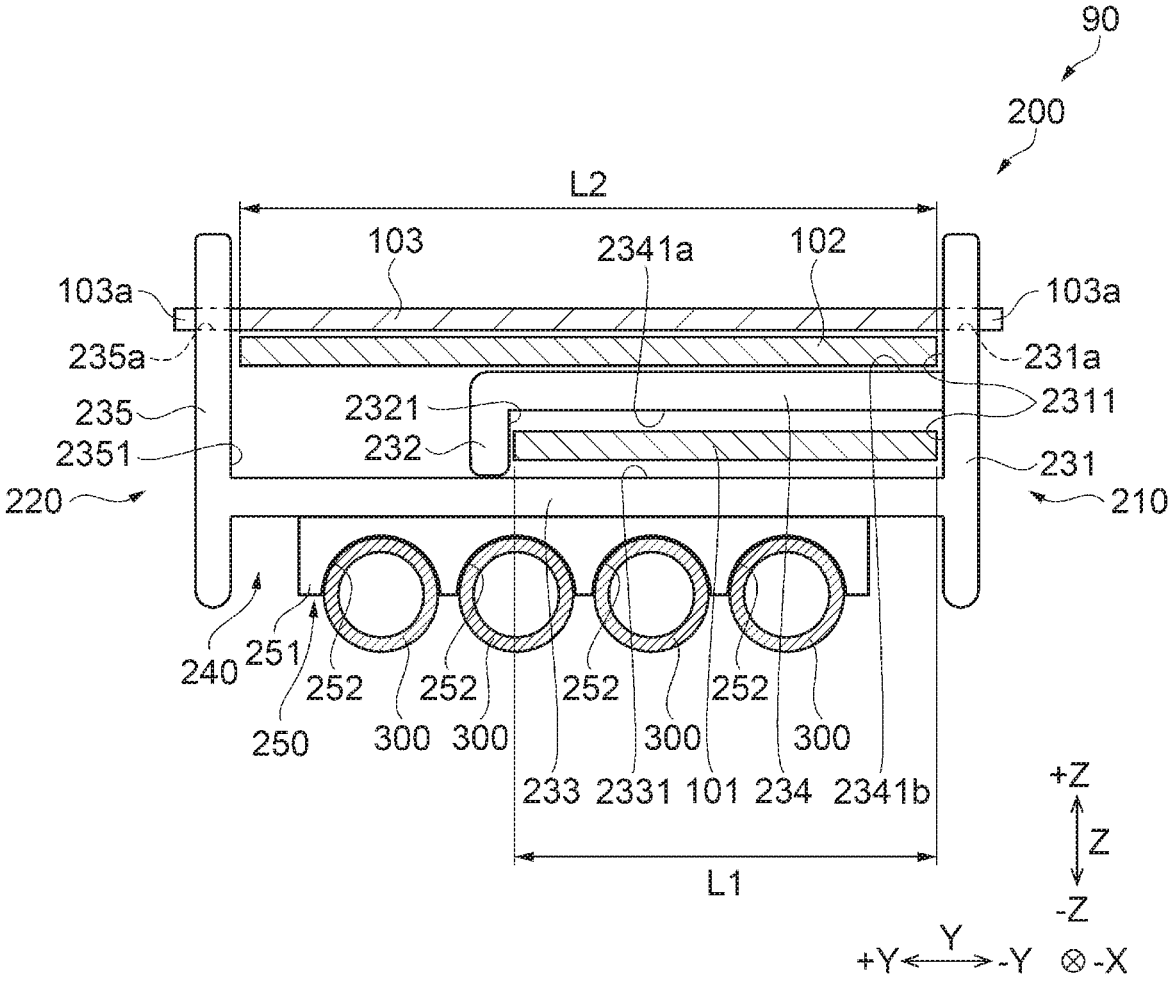
FIG. 6 schematically illustrates in detail the configuration of the strap according to the first embodiment.

As shown in FIG. 6, in this embodiment the width L1 of the first cable 101 and the width L2 of the second cable 102 are different. More specifically, the width L1 of the first cable 101 is shorter than the width L2 of the second cable 102. Note that width L1 and width L2 are the dimensions of the flat part perpendicular to the length of the first cable 101 and second cable 102.

The second cable 102 can carry signals for driving the inkjet head 24 mounted on the carriage 23 and carries more signals than the number of signals carried by the first cable 101. As a result, the second cable 102 has more signal lines. The width L2 of the second cable 102 is therefore greater than the width L1 of the first cable 101. More specifically, the width of the second cable 102 having more lines to carry signals than the first cable 101 is therefore greater than the width of the first cable 101.

As shown in FIG. 4, a photosensor 120, which is a linear encoder for detecting the scanning position of the carriage 23, is disposed to the −Y direction end of the carriage 23. By detecting the scanning position of the carriage 23, the scanning position of the inkjet head 24 supported on the carriage 23 can be indirectly detected. The photosensor 120 includes an emitter that emits light, and a photodetector that detects the light emitted from the emitter. The emitting element of the emitter may be an LED (Light Emitting Diode) emitter or a laser emitter, for example. The photodetector may be configured by a phototransistor or photo IC sensor. The first cable 101 electrically connects the photosensor 120 and control board 33.

The carriage 23 includes a circuit board (first circuit board) with a first connector 131 to which all signal lines in the first cable 101 connect, and a circuit board (second circuit board) with a second connector 132 to which all signal lines in the second cable 102 connect.

More specifically, the first connector 131 is a connector corresponding to the number of signal lines in the first cable 101, and the second connector 132 is a connector corresponding to the number of signal lines in the second cable 102. Therefore, by using first and second connectors 131 and 132 corresponding to the widths L1 and L2 of the first cable 101 and second cable 102, the area occupied by the connectors on the circuit board can be reduced.

A configuration in which the width L1 of the first cable 101 is the same as the width L2 of the second cable 102 is also conceivable. However, in this case there are unnecessary dummy lines in the first cable 101. When the dummy lines are not connected to the first connector 131, the dummy lines may become positively charged and cause noise because the dummy lines are not grounded.

Configurations that ground all signal lines including the dummy lines in the first connector 131 so that all signal lines including the dummy lines are grounded to prevent noise from positive charging are also possible. However, in this case the size of the first connector 131 corresponding to the number of lines in the first cable 101 or the width L1 increases, the footprint of the first connector 131 increases and the circuit board becomes larger, and the carriage 23 therefore also becomes larger. Therefore, by connecting all signal lines in the first cable 101 and second cable 102 to the first and second connectors 131 and 132, noise caused by charging can be prevented, the mounting area on the circuit board can be reduced, and the carriage 23 can be made smaller.

As shown in FIG. 4 the first cable 101 and second cable 102 also have, at the +X direction end, a bent part 119 that curves to the +Y direction. The first and second cables 101 and 102 thus change direction to the side of the carriage 23 and are connected to the first and second connectors 131 and 132, respectively.

The strap 90 also has clamps 200 that hold the first cable 101 and second cable 102 together. The detailed configuration of the clamps 200 is described below.

As shown in FIG. 4 and FIG. 5, part of the first cable 101 and second cable 102 is disposed inside the guide member 29, and part is located outside the guide member 29. The part of the first cable 101 and second cable 102 located inside the guide member 29 is the part disposed at the top vertically above the bottom of the guide member 29. The part of the first cable 101 and second cable 102 located outside the guide member 29 is the part disposed vertically below the bottom of the guide member 29.

Multiple ribs are formed as supports 36 on the bottom of the guide member 29 at a specific interval on the X-axis. Also formed to the bottom of the guide member 29 is a fastener 37 through which the first cable 101 and second cable 102 are threaded and held. The fastener 37 has a roughly W-shaped upper catch 38 when seen from the Y-axis, and a round lower catch 39. The first cable 101 and second cable 102 are secured in a zigzag shape between the upper catch 38 and lower catch 39. The first cable 101 and second cable 102 are secured by the fastener 37 with the part of the first cable 101 and second cable 102 on the carriage 23 side of the part held by the upper catch 38 and lower catch 39 returning to the −X direction side.

On the inside of the guide member 29, the part of the first cable 101 and second cable 102 continuing to the carriage 23 side from the part that is held lengthwise by the fastener 37 and returns to the −X direction reverses again and curves to the +X direction side. The strap 90 therefore forms a curved looped portion 40 inside the guide member 29.

More specifically, the first cable 101 and second cable 102 form a looped portion 40 with a variable amount of slack by the part that continues to the carriage 23 side from the return at the fastener 37 inverting to form a convex loop to the −X direction side. When the inkjet head 24 travels bidirectionally on the X-axis with the carriage 23, the looped portion 40 displaces along the X-axis in conjunction with movement of the carriage 23.

For example, when the inkjet head 24 moves to the −X direction on the X-axis, the looped portion 40 moves from the position indicated by the solid lines in FIG. 5 in the direction of the position indicated by the double dot dash lines. Conversely, when the inkjet head 24 moves to the +X direction on the X-axis, the looped portion 40 moves from the position indicated by the double dot dash lines in FIG. 5 toward the position indicated by the solid lines.

As shown in FIG. 4 and FIG. 5, the first cable 101 and second cable 102 have a looped portion 40 formed by bending back at a desired position, and a flat portion 41 supported on the supports 36 from the −Z direction side. More specifically, the part continuing in the long direction of the first cable 101 and second cable 102 from the end of the looped portion 40 on the −Z direction side to the opposite side as the carriage 23 is a ribbon-like flat portion 41.

When the looped portion 40 moves in the −X direction in conjunction with movement of the inkjet head 24, the flat portion 41 deploys from the looped portion 40 and extends on the X-axis. Conversely, when the looped portion 40 moves in the +X direction in conjunction with movement of the inkjet head 24, the flat portion 41 deployed long on the X-axis is gradually taken up in the looped portion 40 and becomes shorter on the X-axis. The flat portion 41, the length of which changes on the X-axis in conjunction with displacement of the looped portion 40, is also supported stably inside the guide member 29 by contacting at least one support 36 on the outside of the looped portion 40.

A support member 110 that supports the strap 90 from vertically below is also disposed to the cable support mechanism 28. The support member 110 has a guide surface **110*a* that guides movement of the strap 90. More specifically, as shown in FIG. 4 and FIG. 5, the support member 110 is located on the +Z direction side of the guide member 29 at a position overlapping on the Z-axis the part of the guide member 29** on the +X direction side.

The guide surface 110*a* is located at least between the side wall 30 and side wall 31 on the Y-axis. The support member 110 extends on the X-axis. The guide surface 110*a* is also flat.

When the carriage 23 moves to the +X direction side, the support member 110 supports the strap 90 and ink tubes 300 as the carriage 23 moves. In other words, when the carriage 23 moves on the X-axis in the area through which the support member 110 extends, at least one of the strap 90 and ink tubes 300 slides along the guide surface 110*a*.

As shown in FIG. 4 and FIG. 5, the ink tubes 300 are disposed between the strap 90 and support member 110. More specifically, when looking from the +Y direction or −Y direction side, and the carriage 23 is positioned overlapping the support member 110, in other words, when the curved parts 119 of the first cable 101 and second cable 102 are above the support member 110, the ink tubes 300 are between the strap 90 and support member 110.

The part of the ink tubes 300 that lengthwise is between the end connected to the inkjet head 24 and the other end connected to the ink tank 18 is disposed along the guide surface 110*a* of the support member 110. The ink tubes 300 form a curving looped portion 40 in the same way as the first cable 101 and second cable 102, but on from the −Z direction side of the guide member 29, travel to the +X direction side, that is, in the opposite direction as the direction (−X direction) in which first cable 101 and second cable 102 continue.

More specifically, in an inkjet printer 11 according to this embodiment, the circuit board 32 is disposed on the −X direction side, and the ink tank 18 is disposed on the +X direction side, on the X-axis center. In other words, the circuit board 32 and ink tank 18 of the inkjet printer 11 according to this embodiment are disposed on the X-axis on opposite sides of the center on the X-axis. In addition, at least one of the part of the strap 90 on the carriage 23 side of the looped portion 40, and the part of the strap 90 on the carriage 23 side of the curved loop in the ink tubes 300, can slide along the guide surface 110*a* and is supported by the support member 110.

Figure 7:
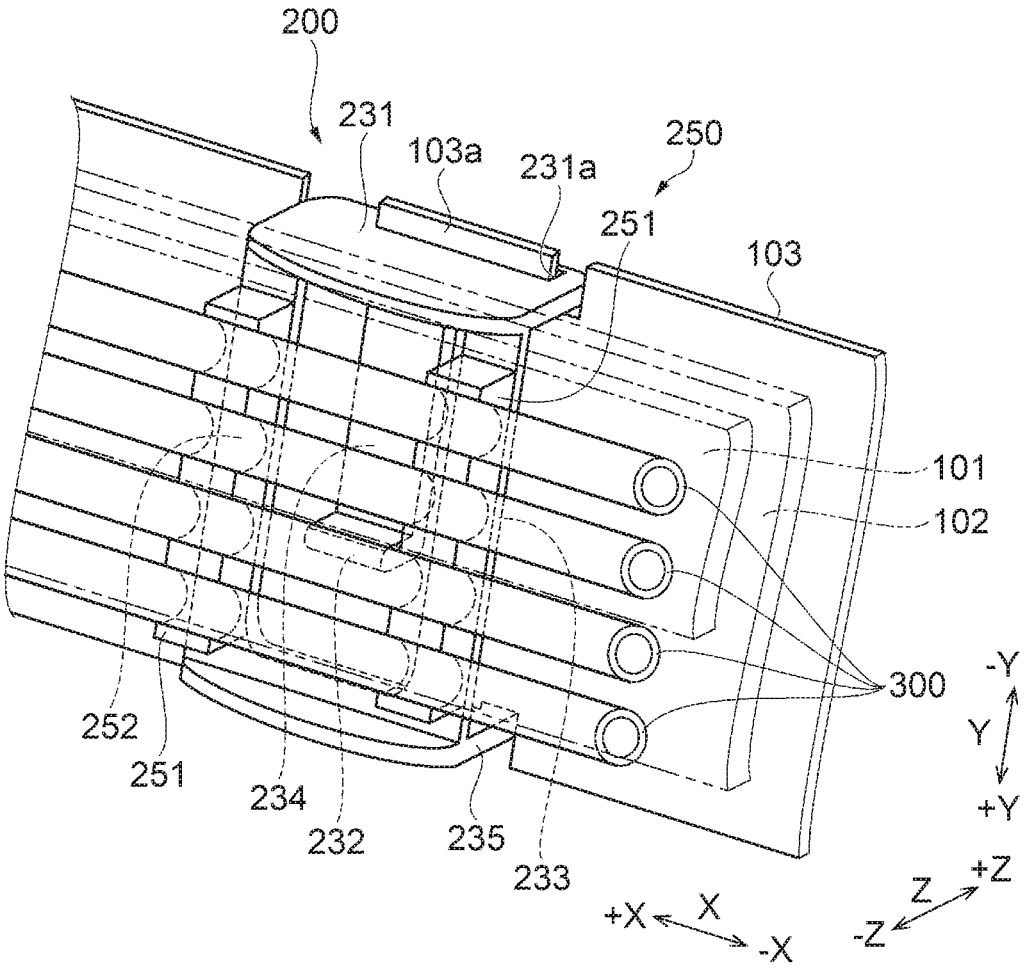
FIG. 7 schematically illustrates in detail the configuration of the strap according to the first embodiment.

The configuration of the strap 90 is described in detail below. FIG. 6 and FIG. 7 show the configuration of the strap 90 in detail. The strap 90 includes the first cable 101, second cable 102, and clamps 200.

As shown in FIG. 6 and FIG. 7, the clamps 200 bundle the first cable 101 and second cable 102 together. As a result, when the carriage 23 moves bidirectionally on the X-axis, the first cable 101 and second cable 102 can move in a bundle in conjunction with movement of the carriage 23 as shown in FIG. 5. The clamps 200 are resin moldings made from plastic, for example.

There are multiple clamps 200. As shown in FIG. 4, there are three clamps 200 in this embodiment. As shown in FIG. 4, when the carriage 23 is at the farthest position in the +X direction, that is, when the first cable 101 and second cable 102 are substantially not supported by the supports 36 of the guide member 29, the multiple clamps 200 are disposed to the first cable 101 and second cable 102 on the +X direction side of the looped portion 40 at the opposite ends on the X-axis and in the middle in the X-axis direction. In other words, the clamps 200 are disposed at both ends of the X-axis direction and the middle of the X-axis direction of the portion of the first cable 101 and second cable 102 that lengthwise is located on the carriage 23 side of the looped portion 40. As a result, the first cable 101 and second cable 102 are reliably supported at all places along the length.

Note that the number of clamps 200 may vary according to the width of the inkjet printer 11. For example, an inkjet printer 11 capable of printing to paper P with a maximum printable width of 30 inches may have three clamps 200, while a inkjet printer 11 capable of printing to paper P with a maximum printable width greater than 30 inches may have four or more clamps 200.

The clamp 200 has a first holder 210 that corresponds to the width L1 of the first cable 101, and limits widthwise movement of the first cable 101 in the clamp 200. The clamp 200 also has a second holder 220 that corresponds to the width L2 of the second cable 102, and limits widthwise movement of the second cable 102 in the clamp 200.

Note that widthwise movement of the first cable 101 is movement in the Y-axis direction in FIG. 6. More specifically, this refers to movement in a direction intersecting the lengthwise direction of the first cable 101.

Likewise, widthwise movement of the second cable 102 is movement in the Y-axis direction in FIG. 6 and is movement in a direction intersecting the lengthwise direction of the second cable 102.

As shown in FIG. 6, the first holder 210 has a first limiter 231 disposed according to the −Y direction edge of the first cable 101, and a second limiter 232 disposed according to the +Y direction edge of the first cable 101. The first limiter 231 and second limiter 232 are flat. The first limiter 231 and second limiter 232 respectively have a limit surface 2311 and 2321 facing the Y-axis edges of the first cable 101. The limit surfaces 2311 and 2321 are flat surfaces extending at least in the Z-axis direction. The Y-axis edges of the first cable 101 are held between the first limiter 231 and second limiter 232. Because the first cable 101 is held between the first limiter 231 and second limiter 232 on the Y-axis, movement of the first cable 101 in the Y-axis direction relative to the clamp 200 is limited.

The first holder 210 also has a third limiter 233 located on the −Z direction side of the first cable 101, and a fourth limiter 234 located on the +Z direction side of the first cable 101. The third limiter 233 and fourth limiter 234 are also flat members.

The third limiter 233 and fourth limiter 234 also respectively have a limit surface 2331 and 2341*a* facing the flat sides of the first cable 101. The limit surfaces 2331 and 2341*a* are also flat surface extending at least on the Y-axis. The Z-axis sides of the first cable 101 are held between the third limiter 233 and fourth limiter 234. Because the first cable 101 is held between the third limiter 233 and fourth limiter 234 on the Z-axis, movement of the first cable 101 relative to the clamp 200 on the Z-axis is limited.

The first cable 101 is therefore restricted by the first to fourth limiters 231, 232, 233, 234 from moving relative to the clamp 200 on both the Y-axis as the width direction, and the Z-axis as the thickness direction. More specifically, movement of the first cable 101 relative to the clamp 200 in directions other than the lengthwise direction of the first cable 101 is limited.

The second holder 220 includes the first limiter 231 disposed on the −Y direction side of the second cable 102, and a fifth limiter 235 disposed on the +Y direction side of the second cable 102. The first limiter 231 is also used by the first holder 210. The fifth limiter 235 is also flat. The first limiter 231 and fifth limiter 235 respectively have limit surfaces 2311 and 2351 facing the Y-axis edges of the second cable 102. The limit surfaces 2311 and 2351 are flat surfaces extending at least in the Z-axis direction. The Y-axis edges of the second cable 102 are held between the first limiter 231 and fifth limiter 235. Because the second cable 102 is held in the Y-axis direction between the first limiter 231 and fifth limiter 235, movement of the second cable 102 in the direction widthwise to the clamp 200 is limited.

Note that because the width L2 of the second cable 102 is greater than the width L1 of the first cable 101, the distance on the Y-axis between the first limiter 231 and fifth limiter 235 is greater than the distance between the first limiter 231 and second limiter 232 on the Y-axis.

The second holder 220 also includes the fourth limiter 234 disposed on the −Z direction side of the second cable 102. The fourth limiter 234 is also part of the first holder 210. The fourth limiter 234 also has a limit surface 2341*b* opposite the flat part of the second cable 102. The limit surface 2341*b* is a flat surface extending at least on the Y-axis. The fourth limiter 234 limits movement of the second cable 102 to the −Z direction side of the clamp 200.

A support panel 103 is also provided on the +Z side of the second cable 102. As shown in FIG. 5, the support panel 103 extends at least between adjacent clamps 200. The support panel 103 is a relatively thin plate made of plastic or other resin. In this embodiment, a single support panel 103 spans all three clamps 200.

Slotted openings 231*a* and 235*a* are formed in the first limiter 231 and fifth limiter 235, respectively, at positions corresponding to where the support panel 103 of the clamps 200 is located. A protruding tab 103*a* is formed on both Y-axis sides of the support panel 103, and by inserting the tabs tab 103*a* to the openings 231*a* and 235*a*, the clamp 200 is attached to the support panel 103.

Because the support panel 103 is positioned on the +Z direction side of the second cable 102 by engaging the clamp 200 with the support panel 103, movement of the second cable 102 to the +Z direction side of the clamp 200 is limited.

Movement of the second cable 102 in the Y-axis direction relative to the clamp 200 of the second cable 102 is also limited by the first limiter 231 and fifth limiter 235, and movement of the second cable 102 in the Z-axis direction relative to the clamp 200 of the second cable 102 is limited by the fourth limiter 234 and support panel 103. In other words, movement of the second cable 102 relative to the clamp 200 in directions other than the lengthwise direction of the second cable 102 is limited.

The support panel 103 is made from a material with greater rigidity than the first cable 101 and second cable 102. Therefore, when the carriage 23 moves bidirectionally on the X-axis, the support panel 103 follows movement of the carriage 23 without the support panel 103 bending to a greater degree of curvature along the length of the support panel 103 than the looped portion 40. As a result, while the first cable 101 and second cable 102 with relatively low rigidity are supported by the support panel 103, the chance of bending in an unexpected direction following the deforming (bending) movement of the support panel 103 is reduced. In this embodiment, the second cable 102 deforms and moves while supported by the support panel 103. The first cable 101 deforms and moves with the second cable 102 due to the clamps 200.

The clamp 200 has a recess 240 on the support member 110 side. The recess 240 extends in the lengthwise direction of the first and second cables 101 and 102 of the strap 90. As shown in FIG. 6, the recess 240 is an area delimited by the −Z direction end of the first limiter 231, the −Z direction end of the fifth limiter 235, and the third limiter 233. By passing the ink tubes 300 through the recess 240 on the X-axis, shifting in the direction intersecting the lengthwise direction of the ink tubes 300 can be suppressed. More specifically, shifting of the −Z direction end of the first limiter 231 and the −Z direction end of the fifth limiter 235 in the Y-axis direction of the ink tubes 300 is restricted.

In this embodiment, the ink tubes 300 are bundled with the first cable 101 and second cable 102. As a result, flapping of the ink tubes 300 against the first cable 101 and second cable 102 can be suppressed, and vibration caused by the ink tubes 300 and strap 90 colliding can be reduced.

In this embodiment, the ink tubes 300 are bundled with both the first cable 101 and second cable 102, but a configuration in which the ink tubes 300 are bundled with only one of the first cable 101 and second cable 102 is also conceivable. This configuration will also reduce flapping of the ink tubes 300.

Note that compared with a configuration in which the ink tubes 300 are bundled with only one of the first cable 101 and second cable 102, a configuration that bundles the ink tubes 300 with both the first cable 101 and second cable 102 reduces the likelihood of the position of the ink tubes 300 not remaining stable in relation to whichever of the first cable 101 and second cable 102 is not bundled with the ink tubes 300.

The clamp 200 according to this embodiment has a tube holder 250 that holds the ink tubes 300. The tube holder 250 is disposed on the −Z direction side of the third limiter 233 inside the recess 240.

The tube holder 250 has a base member 251 that is long in the Y-axis direction. The base member 251 is affixed with the +Z direction side surface of the base member 251 in contact with the third limiter 233. Recesses 252 in which the ink tubes 300 are inserted are formed in the −Z direction surface of the base member 251. The recesses 252 hold the ink tubes 300 inserted thereto. As shown in FIG. 7, the recesses 252 are formed along the X-axis. The worker can easily bundle the first cable 101 and second cable 102 with the ink tubes 300 by inserting the ink tubes 300 to the recesses 252.

When the ink tubes 300 are held in the tube holder 250, the section of the ink tubes 300 that contacts the recesses 252 along the length of the ink tubes 300 is exposed on the support member 110 side. This exposed portion slides in contact with the support member 110.

More specifically, the depth of the recesses 252 in the Z-axis direction is approximately half of the diameter of the ink tubes 300. When the ink tubes 300 are fit into the recesses 252, the −Z direction side of the ink tubes 300 is not in contact with the recesses 252, this part is not covered by the tube holder 250 and is exposed. This exposed portion can slide against the support member 110. As a result, because the flexible ink tubes 300 can slide directly against the support member 110, vibration of the first cable 101 and second cable 102 is less than when the clamps 200 contact the support member 110. As a result, shifting of the first cable 101 and second cable 102 can be suppressed, and electrical noise can be prevented.

Note that the clamp 200 has a rounded part that curves convexly toward the guide surface 110*a*. More specifically, as shown in FIG. 5 and FIG. 7, the −Z direction end of the first limiter 231 of the clamp 200 forms a convex curve in the −Z direction. Likewise, the −Z direction end of the fifth limiter 235 forms a convex curve in the −Z direction. These rounded parts of the first limiter 231 and fifth limiter 235 oppose the guide surface 110*a*. As a result, when the diameter of the ink tubes 300 is small, for example, these rounded parts of the clamp 200 can slide against the guide surface 110*a*, and the load can be reduced when the clamp 200 slides in contact with the guide surface 110*a*.

Figure 8:
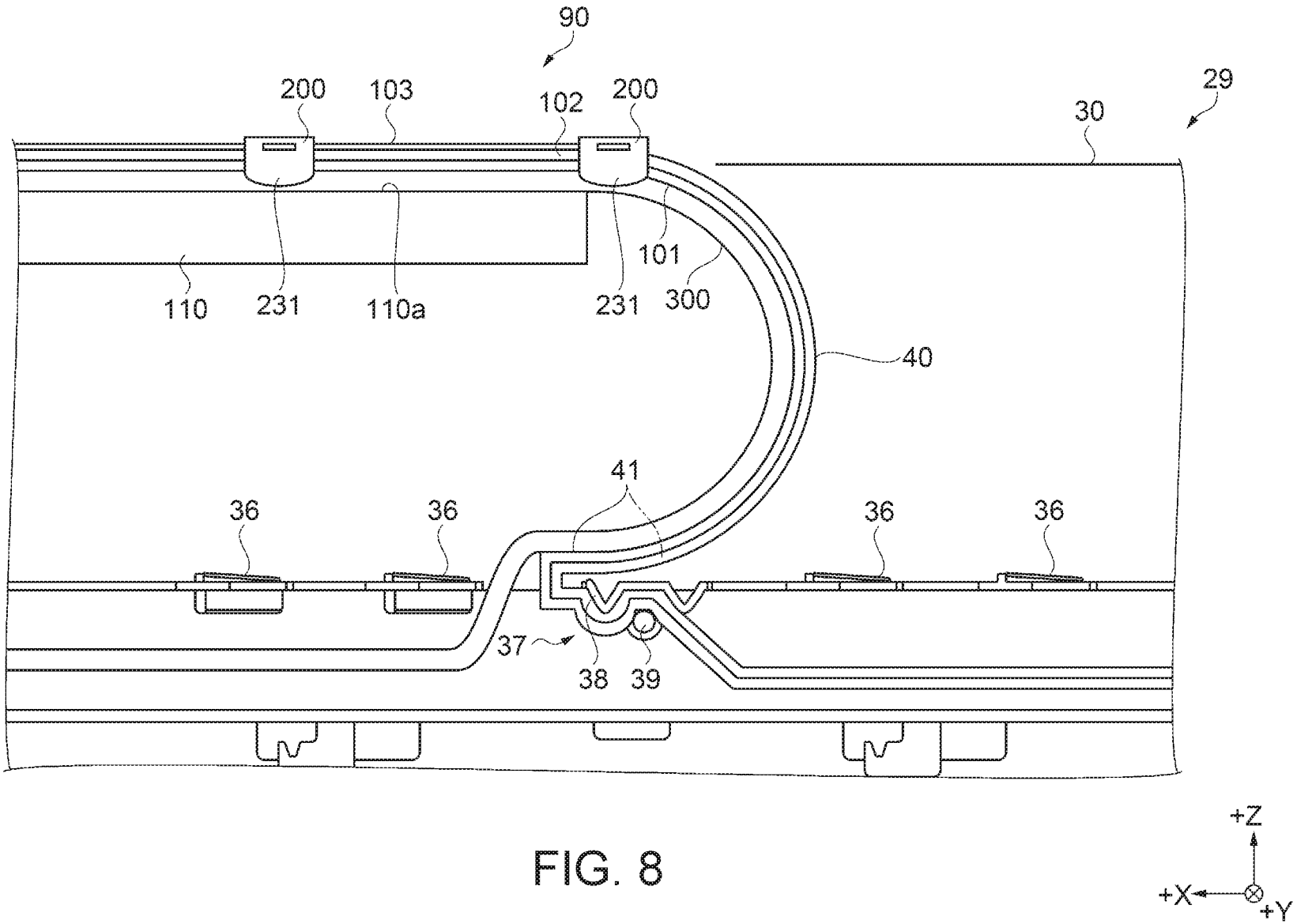
FIG. 8 schematically illustrates the operation of the strap according to the first embodiment.
Figure 9:
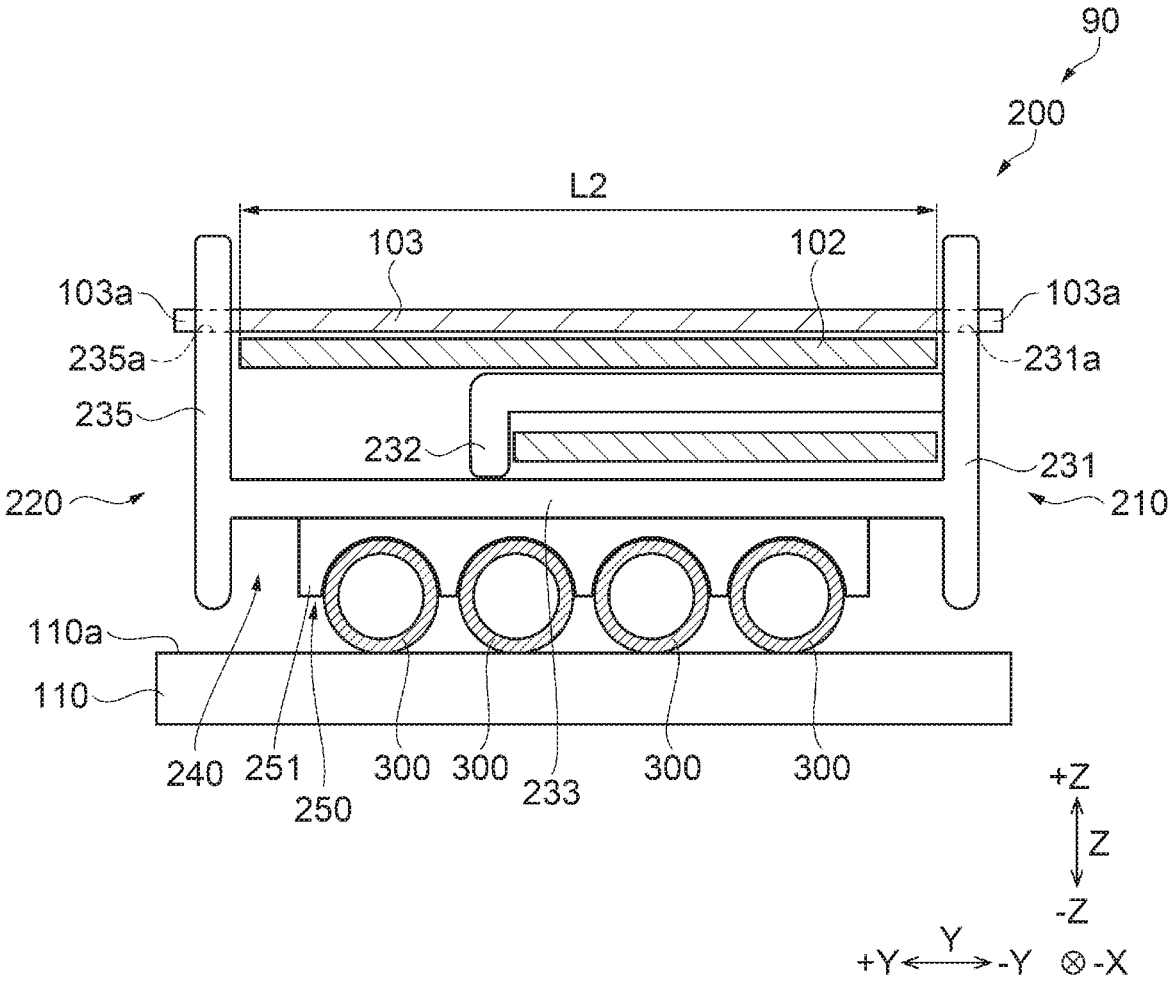
FIG. 9 schematically illustrates the operation of the strap according to the first embodiment.

Operation of the strap 90 is described next. FIG. 8 and FIG. 9 schematically illustrate the operation of the strap 90.

As shown in FIG. 5, when the carriage 23 moves to the −X direction side, the strap 90 moves from the position indicated by the solid line to the position indicated by the double dot dash line in FIG. 5. At this time, one clamp 200 moves in conjunction with movement of the strap 90 from the area above the support member 110 to the area separated from the support member 110 as shown in the example shown in FIG. 5.

When the carriage 23 then moves from this position to the +X direction side, the strap 90 moves from the position indicated by the double dot dash line to the position indicated by the solid line in FIG. 5. In the example in FIG. 5, the clamps 200 move in conjunction with movement of the strap 90 from the area separated from the support member 110, that is, the area not in contact with the support member 110, to the area over the support member 110.

FIG. 8 shows when the strap 90 moved from the position indicated by the double dot dash line to the position indicated by the solid line in FIG. 5, and the clamp 200 is positioned at the −X direction end of the support member 110.

Problems related to movement of the strap 90 on the X-axis are described next.

Conventionally, when the clamp 200 moves toward the support member 110 from the area separated from the support member 110 in conjunction with movement of the carriage 23, the clamp 200 reaches the area over the support member 110 after the clamp 200 and −X direction end of the support member 110 collide. A problem with this operation is that the collision of the clamp 200 with the −X direction end of the support member 110 produces noise.

This problem is unavoidable due to the configuration of the clamp 200. More specifically, when multiple cables, the first and second cables 101 and 102 in this example, are held together in a bundle, the clamp 200 is a configuration that holds the edges in the direction perpendicular to the length of the first and second cables 101 and 102.

More specifically, the clamp 200 is a configuration that holds the surface on one side of the cable located on one side of the direction in which the cables are stacked, and the surface on the other side of the cable located on the other side of the direction in which the cables are stacked. As a result, the part that holds the surface on the one side of the cable located on one side is a protrusion to the one side from the surface on the one side, and the part that holds the surface on the other side of the cable located on the other side protrudes to the other side relative the surface on the other side. As a result, when the clamp 200 rides onto the support member 110, the parts of the clamp 200 that protrude from the cables collide with the support member 110, producing noise.

To solve this problem, this embodiment places the ink tubes 300 between the strap 90 and the support member 110. As shown in FIG. 9, the ink tubes 300 are disposed so that the −Z direction side of the ink tubes 300 is located further to the −Z direction side than, that is, below, the −Z direction ends of the first limiter 231 and fifth limiter 235. More specifically, this disposition of the ink tubes 300 produces a gap between the −Z direction ends of the first limiter 231 and fifth limiter 235 of the clamp 200, which protrude the farthest to the −Z direction, and the guide surface 110*a* of the support member 110. In other words, the position of the clamp 200 is raised by the thickness (diameter) of the ink tubes 300.

Therefore, when the strap 90 moves, the clamps 200 are prevented from colliding with the support member 110, and noise is suppressed.

Effects of this embodiment are described below.

The ink tubes 300 are located between the strap 90 and support member 110. This creates a gap between the clamp 200 and the guide surface 110*a*. As a result, when the strap 90 moves relative to the support member 110, collision between the clamps 200 and support member 110 is prevented and resulting noise can be reduced.

Furthermore, because collision between the clamps 200 and the support member 110 is prevented, shifting of the first cable 101 and second cable 102 is also suppressed. As a result, creating electrical noise can also be prevented.

Yet further, because collision between the clamps 200 and support member 110 is prevented, vibration of the first cable 101 and second cable 102 is also reduced. As a result, vibration of the carriage 23 connected to the first and second cables 101 and 102 is also reduced, and deviation in the landing spot of the ink ejected from the inkjet head 24 can also be reduced.

Note that if the diameter of the ink tubes 300 is small, the −Z direction side of the ink tubes 300 may be located on the +Z direction side of the −Z direction ends of the first limiter 231 and fifth limiter 235 of the clamp 200. In this case, however, the area of collision between the clamp 200 and support member 110 is reduced according to the thickness of the ink tubes 300 in the Z-axis direction. As a result, the force of collision is buffered compared with a configuration in which the ink tubes 300 are not located between the strap 90 and support member 110, and production of noise is reduced.

Embodiment 2

A second embodiment is described next. Primarily configurations that are different in this embodiment and the first embodiment, particularly the configuration of the strap 90A, are described below. Note that the configuration of the inkjet printer 11 is the same as in the first embodiment, and further description thereof is omitted.

Figure 10:
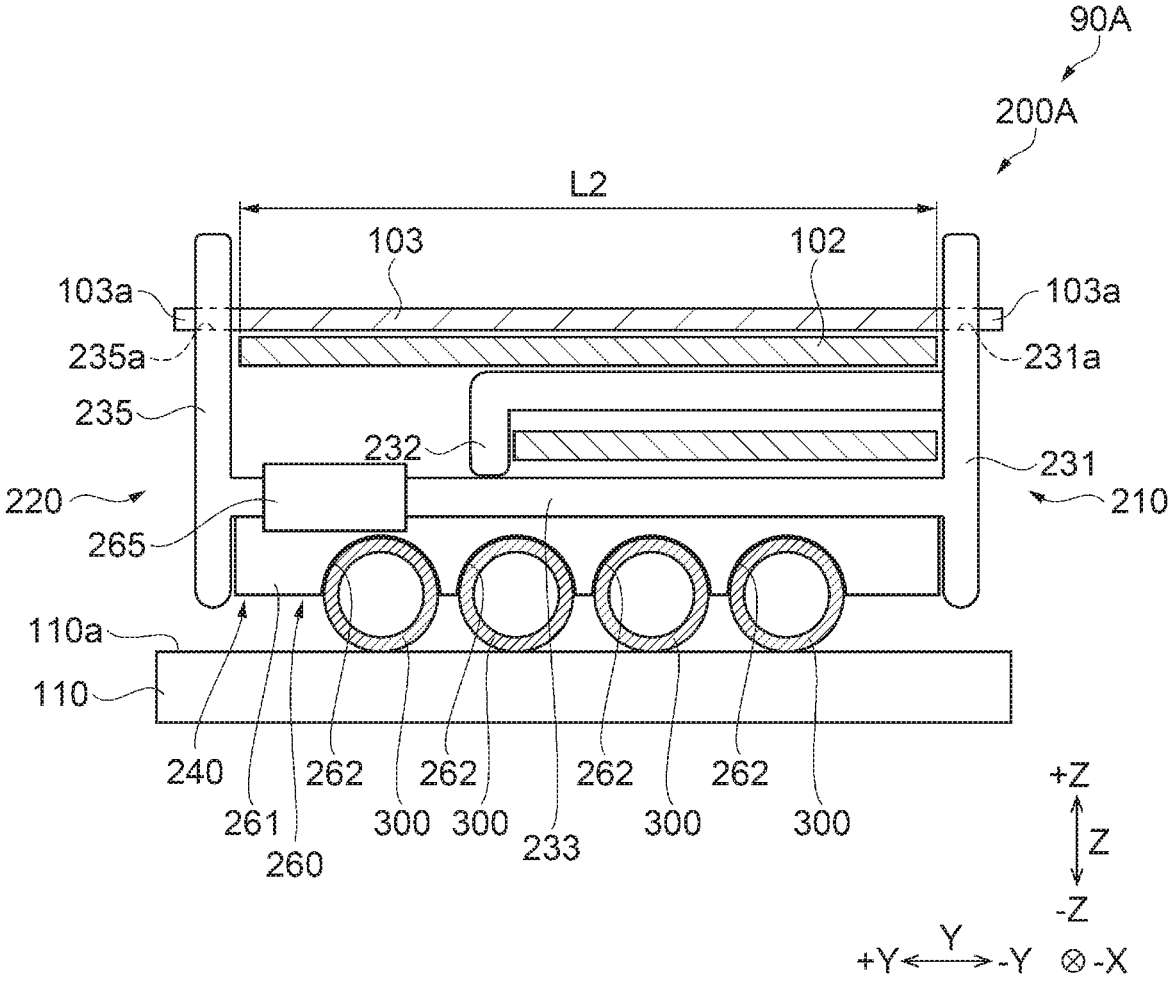
FIG. 10 schematically illustrates the configuration of a strap according to a second embodiment.

FIG. 10 schematically illustrates the configuration of a strap 90A according to this embodiment.

As shown in FIG. 10, the strap 90A includes a first cable 101, a second cable 102, and a clamp 200A. Note that the configurations of the first cable 101 and second cable 102 are the same as in the first embodiment, and further description thereof is omitted.

The clamp 200A bundles the first cable 101 and second cable 102 together. Note that the clamp 200A according to this embodiment is configured without the tube holder 250 of the clamp 200 according to the first embodiment. Except for the tube holder 250, the clamp 200A is therefore the same as the configuration of the first embodiment, and further description thereof is omitted.

A tube clamp 260 that holds the ink tubes 300 is attached to the clamp 200A of the strap 90A according to this embodiment. More specifically, in this strap 90A, the clamp 200A that bundles the first cable 101 and second cable 102, and the tube clamp 260 that holds the ink tubes 300, are configured separately.

The tube clamp 260 is located inside the recess 240 on the −Z direction side of the third limiter 233. The tube clamp 260 has a base member 261 that is long in the Y-axis direction. A hook 265 that catches the third limiter 233 is disposed to the end of the base member 261 on the +Z direction side. A worker attaches the hook 265 to the third limiter 233 with the +Z direction side of the base member 261 in contact with the third limiter 233. As a result, the tube clamp 260 is attached to the clamp 200A.

Recesses 262 for holding the ink tubes 300 inserted thereto are formed in the −Z direction surface of the base member 261. The recesses 262 are formed along the X-axis. By the ink tubes 300 being pressed into the recesses 262, the ink tubes 300 are held by the tube clamp 260. As a result, the first cable 101, the second cable 102, and the ink tubes 300 are bundled together.

When the ink tubes 300 are held in the tube clamp 260, the support member 110 side of the section of the ink tubes 300 that contacts the recesses 262 along the length of the ink tubes 300 is exposed. This exposed portion slides along the support member 110. More specifically, the depth of the recesses 262 in the Z-axis direction is approximately half of the diameter of the ink tubes 300.

When the ink tubes 300 are fit into the recesses 262, the −Z direction side of the ink tubes 300 is not in contact with the recesses 262, and when seen from the X-axis, the part of the ink tubes 300 that is not in contact with the recesses 262 is exposed. The part that is exposed when the ink tubes 300 are fit in the recesses 262 is the part that slides against the support member 110. As a result, because the ink tubes 300 directly contact the support member 110, vibration of the first cable 101 and second cable 102 is reduced. As a result, shifting of the first cable 101 and second cable 102 can be suppressed, and electrical noise can be prevented.

In addition to the effects described above, this embodiment has the following effects.

The tube clamp 260 in which the ink tubes 300 are held is a configuration that can be attached to the clamp 200A. As a result, the tube clamp 260 can be removed from the clamp 200A while the first cable 101 and second cable 102 remain held in the clamp 200A, and where the ink tubes 300 are attached to the clamp 200A can be easily adjusted.

The invention is not limited to the foregoing embodiments and can be modified and improved in many ways without departing from the scope of the invention. Examples of such variations are described below.

Variation 1

The second embodiment describes a configuration that holds the ink tubes 300 by means of a tube clamp 260 that attaches to the clamp 200A, but the invention is not so limited. For example, configurations omitting the tube clamp 260 are conceivable.

Figure 11:
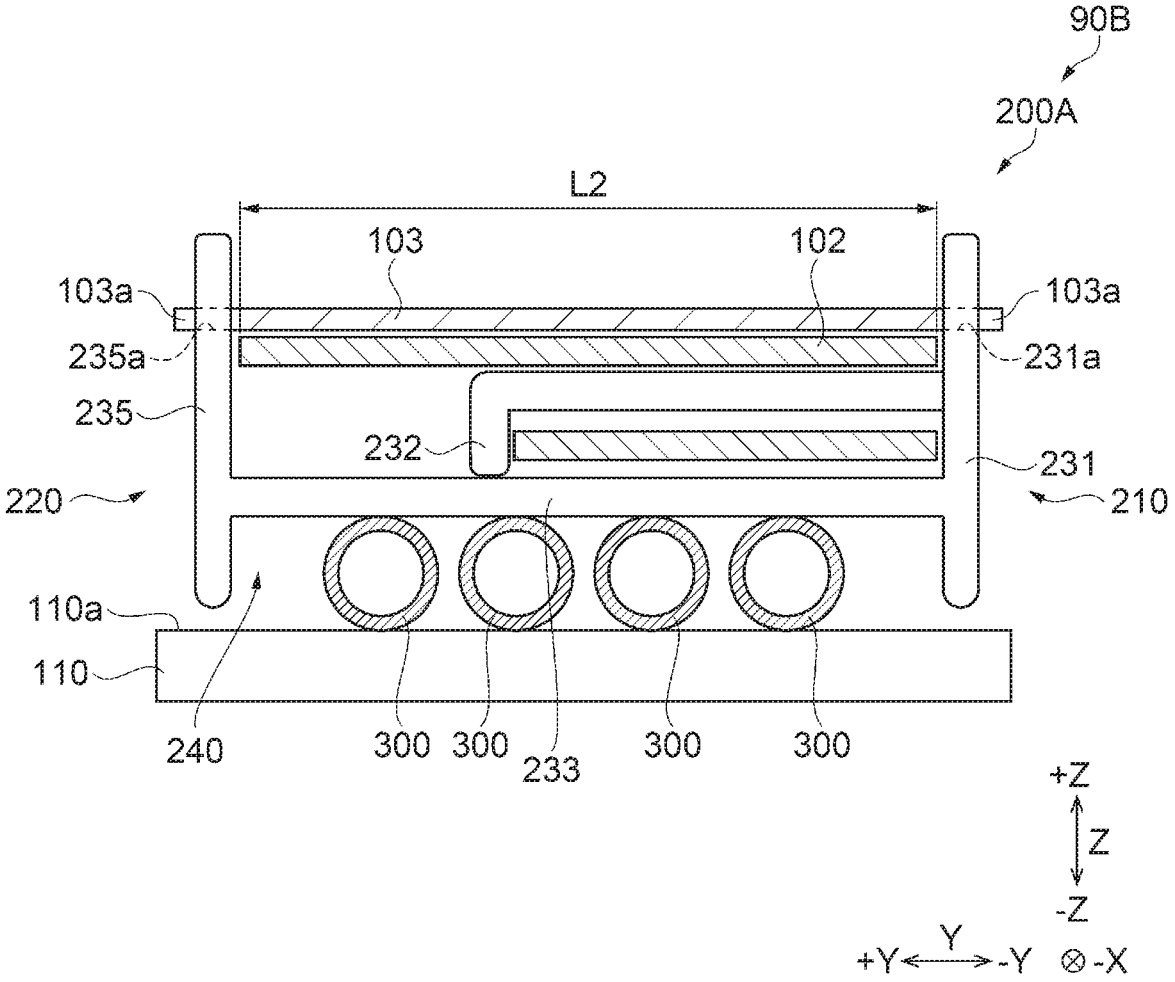
FIG. 11 schematically illustrates the configuration of a strap according to another embodiment.

FIG. 11 shows an example of the configuration of a strap 90B according to this variation. As shown in FIG. 11, the clamp 200A of the strap 90B is configured without a member that holds the ink tubes 300 (such as the tube clamp 260 in the second embodiment).

As shown in FIG. 11, the ink tubes 300 may be disposed to move freely relative to the strap 90B instead of the ink tubes 300 being held by the clamp 200A of the strap 90B. In other words, the ink tubes 300 may be movable freely relative to the strap 90B. More specifically, the ink tubes 300 are disposed between the strap 90B and support member 110. The ink tubes 300 are disposed so that they pass through the recess 240 along the X-axis. As a result, shifting of the ink tubes 300 in a direction intersecting the length of the ink tubes 300 can be suppressed by the −Z direction ends of the first limiter 231 and fifth limiter 235 forming the recess 240.

In addition, because the ink tubes 300 are not bundled with the strap 90B, the ink tubes 300 can be easily replaced.

Variation 2

The first embodiment describes a configuration having a clamp 200 that bundles the first and second cables 101 and 102, but the invention is not so limited, and a cable tie or other type of band may be used as a clamp. This configuration has the same effects as described above.

The foregoing embodiments can be summarized as described below.

An inkjet printer according to the present disclosure has a carriage that carries an inkjet head and configured to scan a recording medium; a main circuit board with a controller that controls the carriage; a strap including a first cable that connects to a first circuit board disposed on the carriage and to the main circuit board, a second cable that connects to a second circuit board disposed on the carriage and to the main circuit board, and a clamp configured to bundle the first cable and the second cable; a support member configured to support the strap from vertically below; and an ink tube configured to connect to the inkjet head and to an ink tank located outside of the carriage. The ink tube is disposed between the strap and the support member.

This configuration disposes the ink tube between the strap and the support member. As a result, when the strap moves relative to the support member, the collision area (contact) between the clamp and the support member is reduced according to the size of the diameter of the ink tube compared with a configuration not having an ink tube. The force of impact between the clamp and support member is therefore suppressed, and production of noise can be reduced.

The clamp in the inkjet printer described above, may also have, on the support member side, a recess extending lengthwise to the strap.

In this configuration the ink tube may also be routed through the recess in the clamp. In this case, the recess functions as a limiter restricting shifting of the ink tube and shifting in a direction intersecting the lengthwise direction of the ink tube can be suppressed.

In the inkjet printer described above, the ink tube may be bundled with the first cable and second cable.

This configuration suppresses flapping of the ink tube against the first cable and second cable and can reduce vibration caused by collisions between the ink tube and strap.

The clamp in the inkjet printer described above may have a tube holder configured to hold the ink tube.

This configuration enables easily bundling the first tube, second tube, and ink tube by means of the tube holder.

In the inkjet printer described above, a part of the ink tube that contacts the tube holder along the length of the ink tube may be exposed on the support member side.

Because the exposed part of the ink tube and the tube holder are in contact, vibration of the first cable 101 and second cable 102 can be reduced compared with a configuration in which the clamp 200 contacts the support member.

The inkjet printer described above may also have a tube clamp configured to hold the ink tube. The tube clamp is attached to the clamp.

This configuration enables removably attaching a tube clamp that holds the ink tube to the clamp. As a result, the tube clamp can be removed from the clamp while the first cable and second cable remain held, and where the ink tube is attached to the clamp can be easily adjusted.

In the inkjet printer described above, a part, along the length of the ink tube, of the ink tube that contacts the tube clamp may be exposed on the support member side.

This configuration exposes the part of the ink tube that slides against the support member when the ink tube is held by the tube holder or tube clamp. Because the ink tube directly contacts the support member, vibration of the first cable and the second cable is reduced. As a result, shifting of the first cable and second cable is suppressed, and production of electrical noise can be prevented.

The ink tube of the inkjet printer described above may also be movable freely relative to the strap.

This configuration enables easily replacing the ink tube because the ink tube is not bundled together with the strap. More specifically, the ink tube can be easily replaced even when the strap connects the carriage and main circuit board.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer comprising:

a carriage that carries an inkjet head and configured to scan a recording medium;

a main circuit board with a controller that controls the carriage;

a strap including a first cable that connects to a first circuit board disposed on the carriage and to the main circuit board, a second cable that connects to a second circuit board disposed on the carriage and to the main circuit board, and a clamp configured to bundle the first cable and the second cable;

a support member configured to support the strap from vertically below; and an ink tube configured to connect to the inkjet head and to an ink tank located outside of the carriage;

the ink tube disposed between the strap and the support member.

2. The inkjet printer described in claim 1, wherein:

the clamp has, on the support member side, a recess extending lengthwise to the strap.

3. The inkjet printer described in claim 2, wherein:

the clamp has a tube holder configured to hold the ink tube.

4. The inkjet printer described in claim 3, wherein:

a part of the ink tube that contacts the tube holder along the length of the ink tube is exposed on the support member side.

5. The inkjet printer described in claim 2, further comprising a tube clamp configured to hold the ink tube, wherein:

the tube clamp is attached to the clamp.

6. The inkjet printer described in claim 5, wherein:

a part, along the length of the ink tube, of the ink tube that contacts the tube clamp is exposed on the support member side.

7. The inkjet printer described in claim 1, wherein:

the ink tube is bundled with the first cable and second cable.

8. The inkjet printer described in claim 1, wherein:

the ink tube is movable freely relative to the strap.

* * * * *